US011845102B2

(12) United States Patent
Wirz Luchsinger

(10) Patent No.: US 11,845,102 B2
(45) Date of Patent: Dec. 19, 2023

(54) SPRAYER DEVICES AND RELATED METHODS

(71) Applicant: WIRZ HOLDINGS, LLC, Lagos de Moreno (MX)

(72) Inventor: Pedro Wirz Luchsinger, Lagos de Moreno (MX)

(73) Assignee: Wirz Holdings, LLC, Jalisco (MX)

( * ) Notice: Subject to any disclaimer, the term of this patent is extended or adjusted under 35 U.S.C. 154(b) by 80 days.

(21) Appl. No.: 17/507,387

(22) Filed: Oct. 21, 2021

(65) Prior Publication Data

US 2022/0111409 A1 Apr. 14, 2022

Related U.S. Application Data

(63) Continuation of application No. 16/188,180, filed on Nov. 12, 2018, now abandoned, which is a (Continued)

(51) Int. Cl.
*B05B 9/08* (2006.01)
*B44D 3/14* (2006.01)

(52) U.S. Cl.
CPC ..... *B05B 9/0816* (2013.01); *B05B 9/085* (2013.01); *B05B 9/0861* (2013.01); *B05B 9/0888* (2013.01); *B44D 3/14* (2013.01)

(58) Field of Classification Search
CPC ..... B05B 9/0816; B05B 9/085; B05B 9/0861; B05B 9/0888; B05B 11/1052;
(Continued)

(56) References Cited

U.S. PATENT DOCUMENTS 1,870,180 A * 8/1932 Long ..... F04B 9/14 74/105
1,884,374 A 10/1932 Tatter
(Continued)

FOREIGN PATENT DOCUMENTS

CA 1291730 C 11/1991
MX 156904 A 10/1988
(Continued)

OTHER PUBLICATIONS

PCT International Search Report dated Jan. 11, 2016 in related PCT Application No. PCT/IB2015/001315.
(Continued)

*Primary Examiner* — Tuongminh N Pham
(74) *Attorney, Agent, or Firm* — Robert D. Buyan; Stout, Uxa & Buyan, LLP

(57) ABSTRACT

Sprayer devices and related methods. The sprayer devices can be of a type that may be carried or worn on the back of a user. Each sprayer device has a tank, a spray outlet (e.g., a spray nozzle or spray wand) and either a manual or power pump. The sprayers may also incorporate one or more of the following: a) a brace member for deterring bending or deformation of a bottom bracket on the sprayer, b) a pump axle with redundant rotation-limiting stop members useable for either right-handed or left-handed operation, c) system for selective and/or controlled agitation or non-agitation of liquid within the sprayer tank and/or d) an information card holding niche with removable information card.

13 Claims, 8 Drawing Sheets

Related U.S. Application Data continuation of application No. 14/186,897, filed on Feb. 21, 2014, now Pat. No. 10,124,355.

(60) Provisional application No. 61/915,343, filed on Dec. 12, 2013, provisional application No. 61/769,706, filed on Feb. 26, 2013, provisional application No. 61/767,993, filed on Feb. 22, 2013.

(58) Field of Classification Search
CPC ..... B05B 11/1056; B05B 11/1057; B05B 12/0022; F04B 9/14
See application file for complete search history.

(56) References Cited

U.S. PATENT DOCUMENTS

| | | | | |
|---|---|---|---|---|
| 2,324,747 | A | 7/1943 | Weissert | |
| 2,413,671 | A | 12/1946 | Wolf et al. | |
| 2,891,480 | A * | 6/1959 | Marcum | F04B 9/14 74/105 |
| 3,039,760 | A | 6/1962 | Jackson | |
| 3,088,726 | A | 5/1963 | Dangauthier | |
| 3,208,760 | A | 9/1965 | Lucien et al. | |
| 3,790,114 | A | 2/1974 | Italiano et al. | |
| 3,807,717 | A | 4/1974 | Ito | |
| 4,111,364 | A | 9/1978 | Schroeder | |
| 4,214,775 | A | 7/1980 | Taft | |
| 4,447,066 | A | 5/1984 | Katagiri et al. | |
| 4,702,416 | A | 10/1987 | Pagliai et al. | |
| 4,702,419 | A | 10/1987 | Luchsinger | |
| D293,705 | S | 1/1988 | Sayward | |
| 4,768,714 | A | 9/1988 | Luchsinger | |
| 4,798,333 | A | 1/1989 | Luchsinger | |
| 4,951,743 | A | 8/1990 | Henderson | |
| 5,240,186 | A | 8/1993 | Dobbins et al. | |
| 5,335,853 | A | 8/1994 | Wirz | |
| 5,478,015 | A | 12/1995 | Black | |
| 5,636,791 | A | 6/1997 | Leer | |
| 5,671,884 | A | 9/1997 | Restive | |
| 5,752,661 | A | 5/1998 | Lewis | |
| 5,775,543 | A | 7/1998 | Wahrenbrock | |
| 5,857,618 | A | 1/1999 | Restive | |
| 5,984,199 | A | 11/1999 | Restive | |
| 6,106,424 | A | 8/2000 | Kratz | |
| 6,412,707 | B1 | 7/2002 | Wirz | |
| 6,729,558 | B1 | 5/2004 | Seenauth | |
| 6,776,378 | B1 | 8/2004 | Yu | |
| 7,007,826 | B2 | 3/2006 | Shapanus et al. | |
| 7,309,028 | B2 | 12/2007 | Langhans et al. | |
| D567,897 | S | 4/2008 | Hillhouse | |
| D570,447 | S | 6/2008 | Hillhouse | |
| D582,000 | S | 12/2008 | Campbell | |
| D591,387 | S | 4/2009 | Campbell | |
| D604,386 | S | 11/2009 | Campbell | |
| D609,773 | S | 2/2010 | Abernethy et al. | |
| D616,959 | S | 6/2010 | Wu | |
| 7,854,396 | B2 | 12/2010 | Wu | |
| D633,984 | S | 3/2011 | Plantz | |
| D643,905 | S | 8/2011 | DeLorme | |
| D652,111 | S | 1/2012 | DeLorme | |
| 8,141,754 | B2 | 3/2012 | Conner et al. | |
| D664,236 | S | 7/2012 | Hudson et al. | |
| D672,848 | S | 12/2012 | Wirz Luchsinger | |
| D685,057 | S | 6/2013 | Wirz Luchsinger | |
| 8,556,192 | B2 | 10/2013 | Wise | |
| 8,616,466 | B2 | 12/2013 | Strauss et al. | |
| D698,889 | S | 2/2014 | Ondarra | |
| D719,638 | S | 12/2014 | Pagliai | |
| D719,639 | S | 12/2014 | Pagliai | |
| D741,452 | S | 10/2015 | Carrozza | |
| 2004/0112982 | A1 | 6/2004 | Dilley | |
| 2006/0255181 | A1 | 11/2006 | Leer et al. | |
| 2006/0261181 | A1 | 11/2006 | Wirz | |
| 2006/0277783 | A1 | 12/2006 | Garton | |
| 2008/0042382 | A1 | 2/2008 | Dodier et al. | |
| 2008/0197207 | A1 | 8/2008 | Engelbrecht et al. | |
| 2010/0230515 | A1 * | 9/2010 | Wu | B05B 9/0877 239/373 |

FOREIGN PATENT DOCUMENTS

| | | | |
|---|---|---|---|
| MX | 157782 | A | 12/1988 |
| MX | 157783 | | 12/1988 |
| MX | 160084 | A | 10/1989 |
| MX | 160085 | A | 10/1989 |
| MX | 185553 | B | 3/1992 |
| MX | 165049 | B | 10/1992 |
| MX | 225563 | B | 9/2004 |
| MX | 344075 | B | 12/2016 |
| WO | WO 2014/087204 | A1 | 6/2014 |

OTHER PUBLICATIONS

Supplementary European Search Report dated Jul. 25, 2016 in related European Application No. 13861050.6.
PCT International Search Report dated Nov. 1, 2013 in related PCT Application No. PCT/IB2013/000945.

* cited by examiner

SPRAYER DEVICES AND RELATED METHODS

RELATED APPLICATIONS

This patent application is a continuation of copending U.S. patent application Ser. No. 16/188,180 filed Nov. 12, 2018, which is a continuation of U.S. patent application Ser. No. 14/186,897 filed Feb. 21, 2014 and issued as U.S. Pat. No. 10,124,355 on Nov. 13, 2018, which claims priority to U.S. Provisional Patent Applications No. 61/767,993 entitled Sprayer Tank With Support Member filed Feb. 22, 2013; 61/769,706 entitled Sprayer Tank With Support Member filed Feb. 26, 2013 and 61/915,343 entitled Sprayer Devices and Related Methods filed Dec. 12, 2013, the entire disclosure of each such application being expressly incorporated herein by reference.

FIELD OF THE INVENTION

The present invention relates generally to the fields of mechanical and fluid/hydraulic engineering and more particularly to sprayer devices and their methods of use.

BACKGROUND

The prior art has included numerous sprayers for agricultural or other uses having tanks that may be worn on the back of a worker who is operating the sprayer. These devices are generally referred to herein as "backpack sprayers."

The backpack sprayers of the prior art have included both manually operated sprayers and power sprayers. The manually operated backpack sprayers have typically incorporated a hand pump having a handle that is manually moved up and down to operate the sprayer. The power backpack sprayers have typically incorporated a battery-powered electric motor that drives the sprayer pump.

Certain recent improvements relating to backpack type sprayers are described in Applicant's U.S. Provisional Patent Applications No. 61/767,993 (filed Feb. 22, 2013) and 61/769,706 (filed Feb. 26, 2013), the entire disclosures of which are expressly incorporated by reference.

Further examples of backpack type sprayers devices are described in U.S. Pat. No. 7,309,028 (Langhans et al.), U.S. Pat. No. 6,412,707 (Wirz), U.S. Pat. No. D591,387 (Campbell), U.S. Pat. No. 5,984,199 (Restive), U.S. Pat. No. 5,857,618 (Restive), U.S. Pat. No. 5,671,884 (Restive), U.S. Pat. No. 5,636,791 (Leer), U.S. Pat. No. 5,478,015 (Black), U.S. Pat. No. 4,798,333 (Luchsinger), U.S. Pat. No. 4,768,714 (Luchsinger) and U.S. Pat. No. 4,702,416 (Pagliali et al.)

There remains a need in the art for the development of new manual and power sprayers that incorporate features or components that overcome problems or shortcomings associated with such sprayers of the prior art.

SUMMARY OF THE INVENTION

The present inventions provide sprayer devices and related methods. The sprayer devices can be of a type that may be carried or worn on the back of a user. The sprayer devices have a tank, a spray outlet (e.g., a spray nozzle or spray wand) and either a manual or power pump for spraying liquid from the tank out of the spray outlet. The sprayer devices may also incorporate one or more of the following: a) a brace member for deterring bending or deformation of a bottom bracket on the sprayer, b) a pump axle with redundant rotation-limiting stop members useable for either right-handed or left-handed operation, c) system for selective and/or controlled agitation or non-agitation of liquid within the sprayer tank and/or d) an information card holding niche with removable information card.

Further elements, aspects and details of the present inventions will be appreciated by those of skill in the relevant art from the following detailed description of examples and the accompanying figures to which it refers.

BRIEF DESCRIPTION OF THE FIGURES

The detailed description and examples set forth below refers to FIGS. 1 through 11, which are briefly described as follows.

DETAILED DESCRIPTION OF EXAMPLES

The following detailed description and the accompanying drawings to which it refers are intended to describe some, but not necessarily all, examples or embodiments of the invention. The described embodiments are to be considered in all respects only as illustrative and not restrictive. The contents of this detailed description and the accompanying drawings do not limit the scope of the invention in any way.

Figure 1:
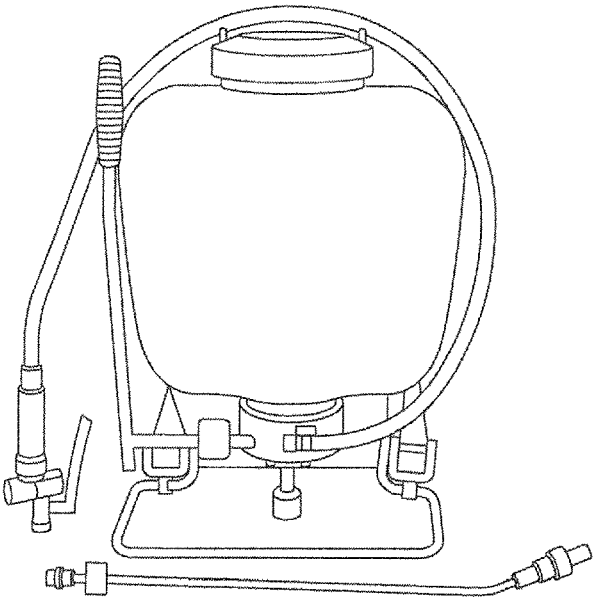
FIG. 1 (Prior Art)
FIG. 1 is a perspective view of a manual backpack sprayer device of the prior art.
Figure 2:
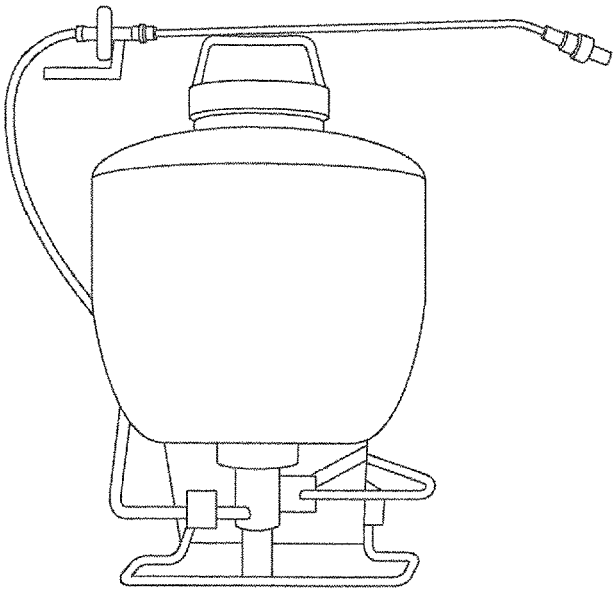
FIG. 2 (Prior Art)
FIG. 2 is a perspective view of a power backpack sprayer device of the prior art.
Figure 3:
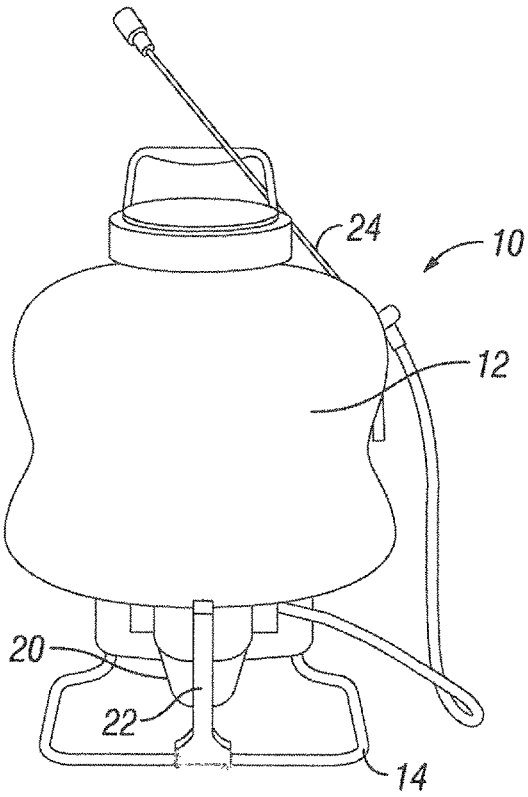
FIG. 3 is a perspective view of a backpack sprayer device incorporating a brace member in accordance with the present invention.
Figure 4:
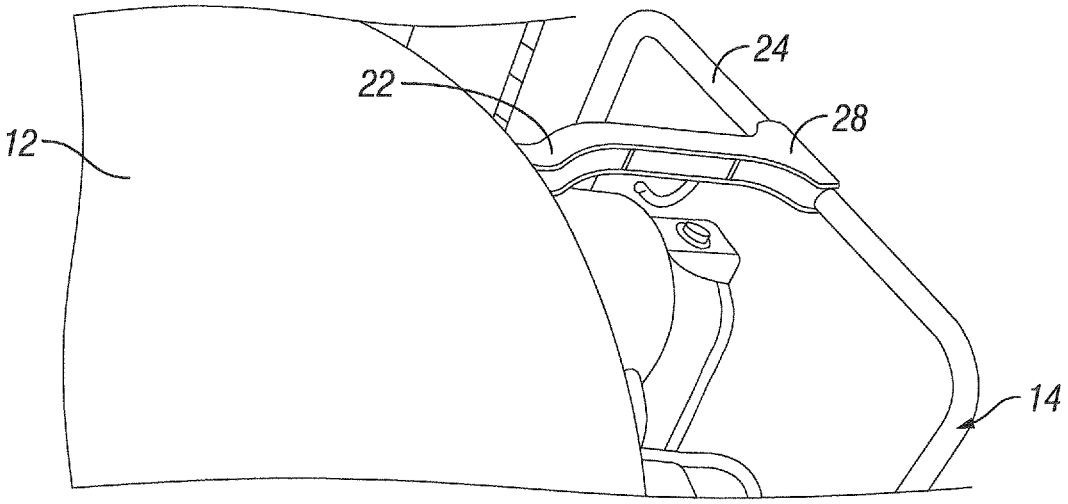
FIG. 4 is a partial view of the bottom portion of the device of FIG. 3.

FIGS. 1 and 2 show backpack sprayer devices of the prior art. The backpack sprayers of the prior art have included both manually operated sprayers (e.g., FIG. 1 above) and power sprayers (e.g., FIG. 2 above). The manually operated backpack sprayers have typically incorporated a hand pump having a handle that is manually moved up and down to operate the sprayer. The power backpack sprayers have typically incorporated a battery-powered electric motor that drives the sprayer pump.

A. Brace Member

FIGS. 3 through 6 show a sprayer device 10 which incorporates a brace member 22 of the present invention. This sprayer device 10 is shown as an example of a power type sprayer device, but could alternatively be a manual pump type device. In this non-limiting example, the sprayer device 10 comprises a tank 12 with a base bracket 14 extending beneath the tank as shown. A pump 16 and a spray outlet port 18 are located at the end of a sprayer wand 20. In accordance with the present invention, a brace member 22 extends between the base bracket 14 and the tank 12. This brace member 22 is operative to deter bending or deformation of the base bracket 14 in the event that excessive downward force is applied to the tank 12 while the device 10 is sitting on an underlying surface such as a floor or the ground. In this example, the base bracket 14 is configured to function as a foot or base upon which the tank will stand when it is placed upon a horizontal underlying surface (e.g., a floor or the ground). In some devices, these base brackets may also serve as a mounting or support for certain components of the sprayer, such as the pump and/or motor components. In at least some sprayers having these types of base brackets 14 without the bract member 22 of the present invention, excessive downward pressure applied to the tank 12 while the device 10 is sitting on an underlying surface (e.g., a floor or the ground) can cause the base bracket 14 to become bent or deformed. Such bending or deformation of the base bracket 14 can cause the device to sit unevenly or topple over and/or can cause damage to other components of the device such as the motor, pump or fluid connections between components. As described herein, the bract member 22 of the present invention prevents or deters such bending or deformation of the base bracket 14.

In the particular example shown, the base bracket 14 has a transverse portion 24 which is not directly affixed to the tank 12 and the brace member 22 extends between the approximate midpoint of the transverse portion 24 of the base bracket 14 and the tank 12. A brace-engaging structure 26 is formed on or in the wall of the tank 12 to facilitate substantially locking engagement (e.g., a snap fit, hook-over fit, undercut abutment, etc.) of the top end of the brace member 22 with the wall of the tank 12, while the bottom end of the brace member 22 is mounted on or affixed to the base bracket 14. In this particular non-limiting example, the bottom end of the brace member 22 has a transverse arcuate portion 28 that pivotally mounts on the upper surface of the transverse portion 24 of the base bracket 14. With this arcuate portion 28 pivotally mounted on the transverse portion 24 of the base bracket 14, the top end of the brace member 22 is then pivoted toward the tank 12 to cause the top end of the brace member 22 to move into substantially locking engagement with the brace-engaging structure 26. In this manner, the brace member 22 is firmly installed such that it provides vertical support between the tank 12 and the transverse portion 24 of the base bracket 14. With the brace member 22 installed in this manner, if downward pressure is applied to the top of the tank 12 while the base bracket 14 is sitting on an underlying surface such as a floor or the ground, the brace member 22 will prevent the base bracket 14 from bending or deforming upwardly toward the tank 12.

Figure 5:
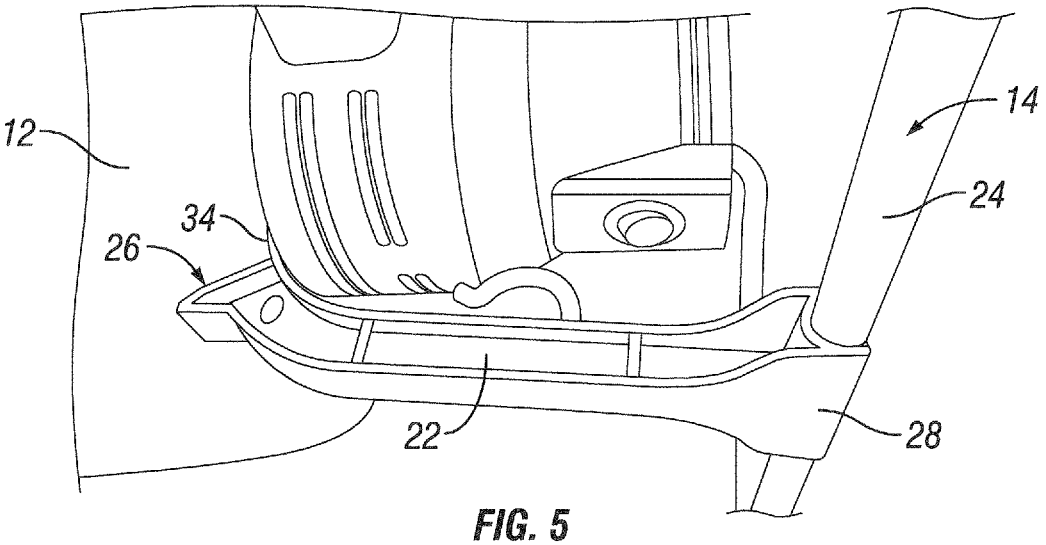
FIG. 5 is a close up view of the brace member of the device of FIG. 3.
Figure 6:
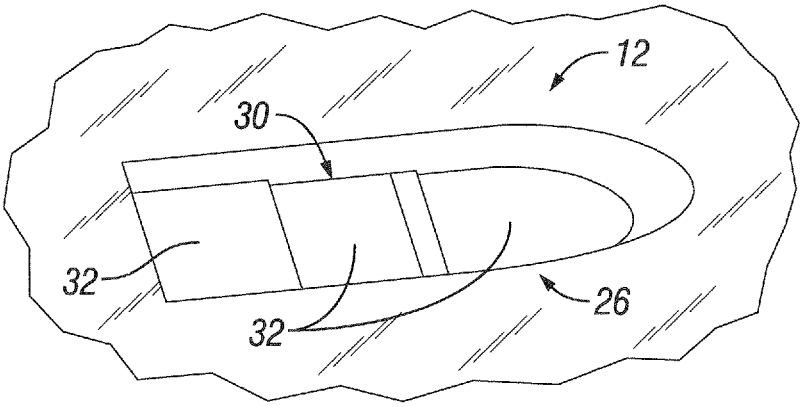
FIG. 6 is a partial view of a bottom area of the tank wall of the device of FIG. 3 with the brace member removed so as to show an indentation with brace member engagement surfaces molded into the wall of the sprayer tank to facilitate snap-fitting of the brace member into place.

In the non-limiting example shown, the brace-engaging structure 26 comprises an indentation 30 that has a stepped inner surface 32 and the top end of the brace member 22 is configured to snap fit within the indentation 30 in abutment with a portion of the stepped surface 32 so that it will not inadvertently pivot back out of the indentation. More particularly, in this example, the top end of the brace member 22 has a retainer projection 34 that protrudes from the upper end of the brace member 22 and abuts against the underside of the tank 12 (as seen in FIG. 5) to deter or prevent the upper end of the brace member 22 from pivoting back out of engagement with the brace-engaging structure 26 once the brace member has been pivotally advanced into engagement with the brace-engaging structure 26.

Although the example provided above uses a snap-fitting arrangement for engagement of the brace member 22 with the wall of the tank 12, it is to be appreciated that various alternative arrangements may be used to secure the brace member 22 in its desired position, such as adhesive, solvent welding, fasteners (e.g., screws or rivets), etc. Also, in some embodiments, the brace member 22 may be formed as an integral portion of either the base bracket 14 or the tank 12. Also, in some embodiments, more than one brace member 22 may be provided. All of these variations are to be deemed within the scope of the present invention.

Figure 12:
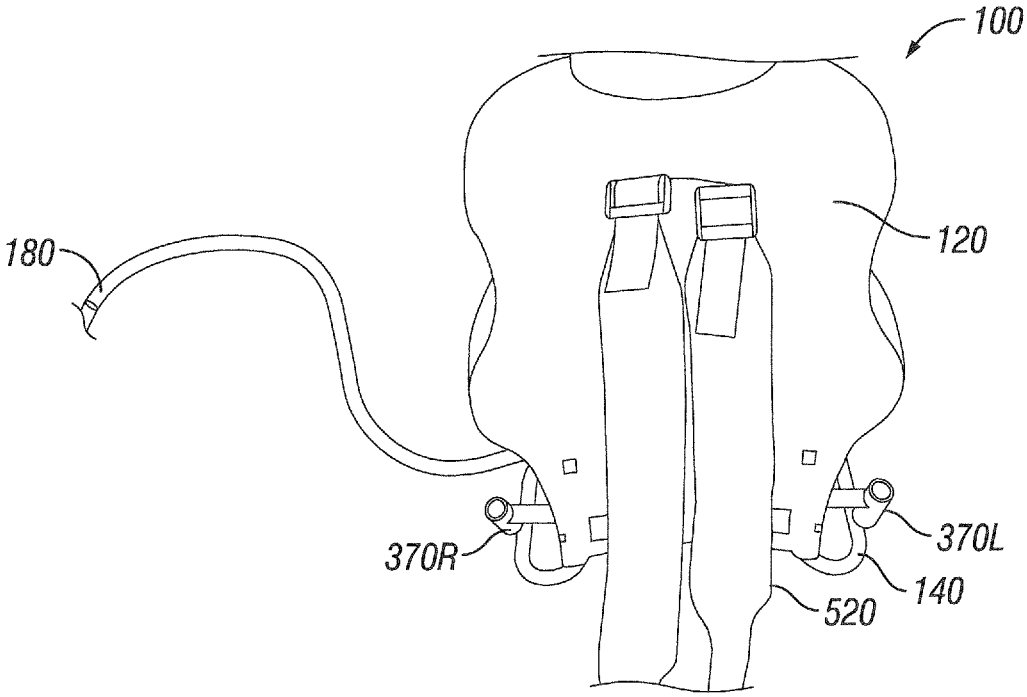
FIG. 12 is another perspective view of the sprayer device of FIG. 7.
Figure 13:
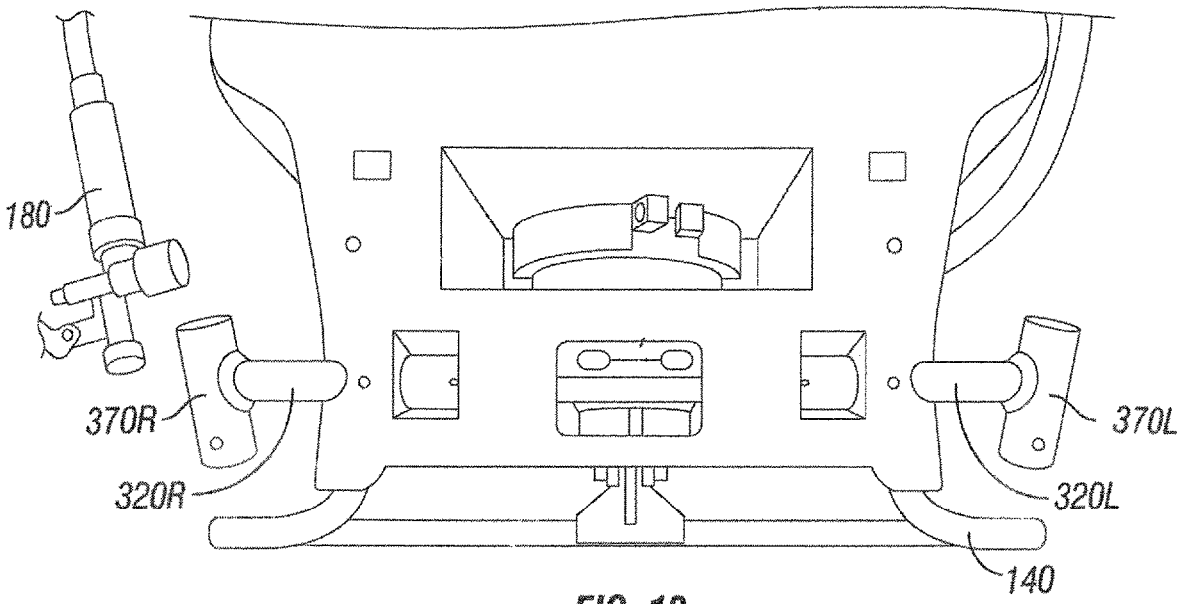
FIG. 13 is a partial perspective view of a bottom portion of the sprayer device of FIG. 7.
Figure 14:
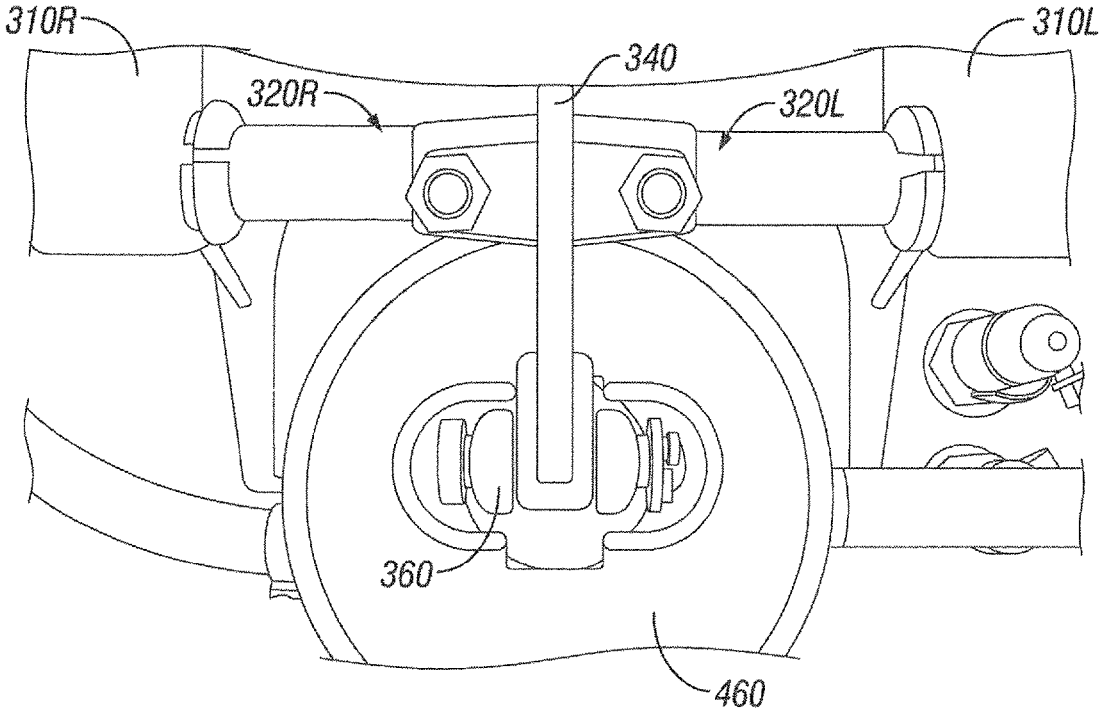
FIG. 14 is a bottom view of the pump region of the sprayer device of FIG. 7.

B. Pump Axle with Redundant Rotation-Limiting Stop Members Useable for Either Right-Handed or Left-Handed Operation Referring to FIGS. 7-17, there is shown a sprayer device 100 having a pump 150 which comprises a hand-driven pump. A pump driving axle 320 is connected to a pump drive bracket 340. The pump axle 320 is constructed to permit a pump handle 160 to be attached to either the right end or left end of the pump axle 320. This facilitates either right-handed or left-handed operation of the device. After the handle 160 has been attached to one end of the pump drive axle 320, the sprayer device 100 may be mounted on the user's back by appropriate means, such as by way of shoulder straps seen in FIG. 12. When it is desired to spray liquid, the user repeatedly moves the pump handle 160 up and down, causing reciprocating clockwise/counterclockwise partial rotation of the pump drive axle 320. This reciprocating clockwise/counterclockwise partial rotation of the pump drive axle 320 causes corresponding back and forth movement of the pump drive bracket 340. This back and forth movement of the pump drive bracket 34 in turn drives the pump (which may be a piston type pump) to pump liquid from the inner space of the tank 120 out of the spray emitting apparatus 180.

In this example, the pump axle 320 comprises a right axle portion 320R and a left axle portion 320L. Axle guides 310R, 310L are formed below the tank 120 on either side of the pump 150. During assembly, the right axle portion 320R is inserted, inner end first, through the right axe guide 310R which is located to the right of the pump 150. The left axle portion 320L is inserted, inner end first, through the left axle guide 310L located to the left of the pump 150.

Figure 7:
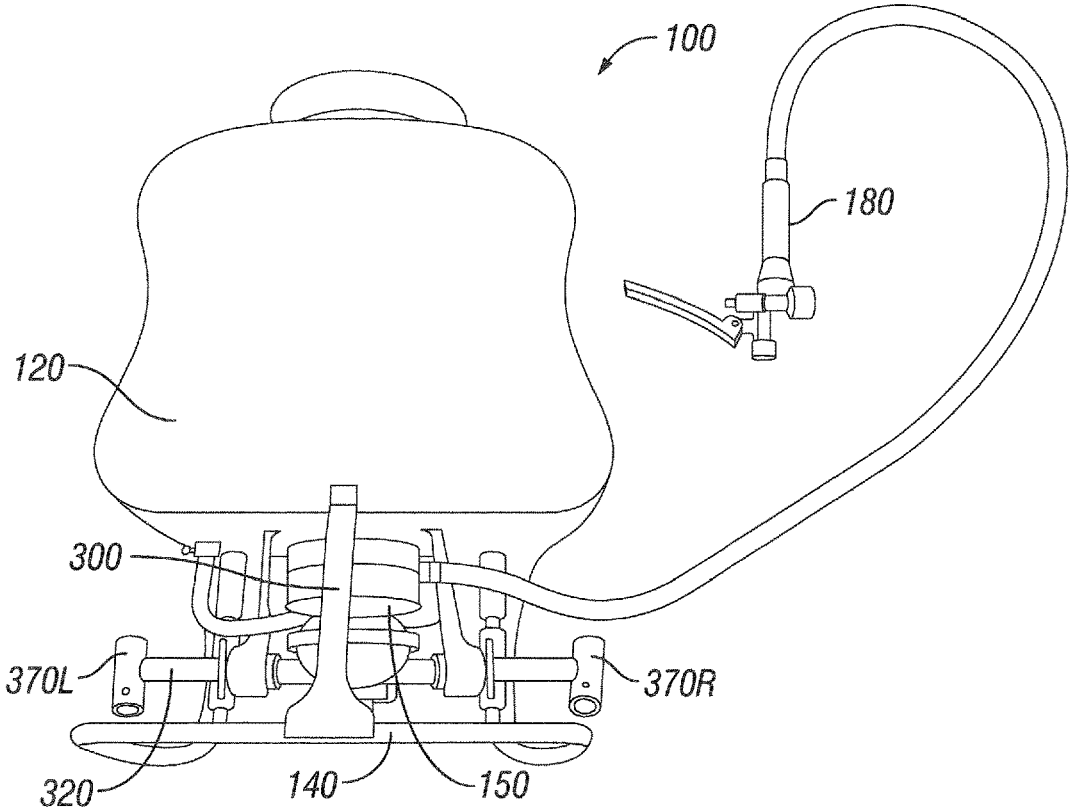
FIG. 7 is a rear perspective view of a manual backpack sprayer device having a brace member, split axle with dual stops for alternate right and left handed use, alternate recirculation/agitation ports and an information card holding niche, in accordance with the present invention.
Figure 8:
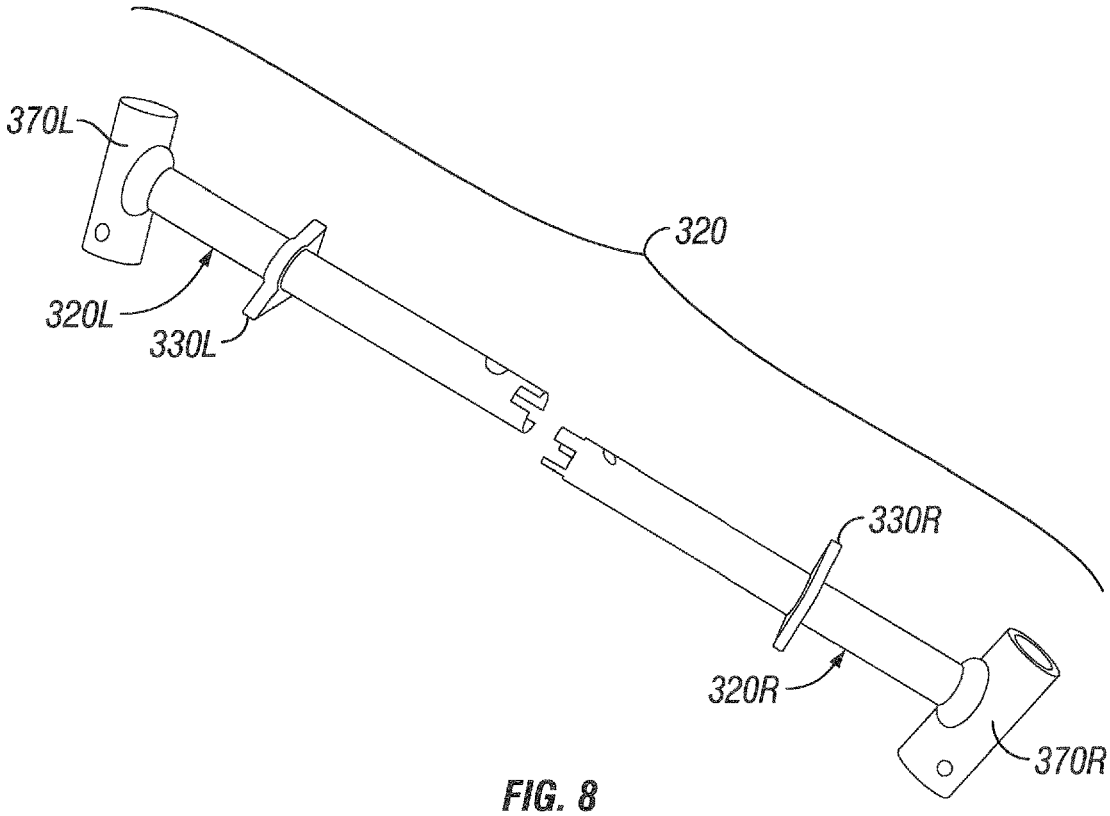
FIG. 8 is an exploded, disassembled view of right and left portions of the split axle of the sprayer device of FIG. 7.
Figure 9:
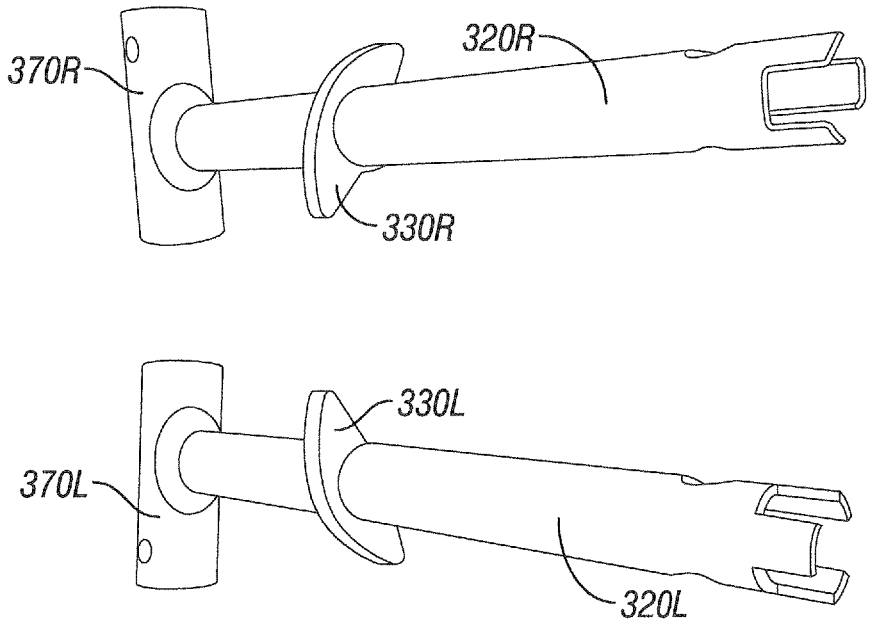
FIG. 9 is another view showing the right and left portions of the split axle of the sprayer device of FIG. 7.
Figure 10:
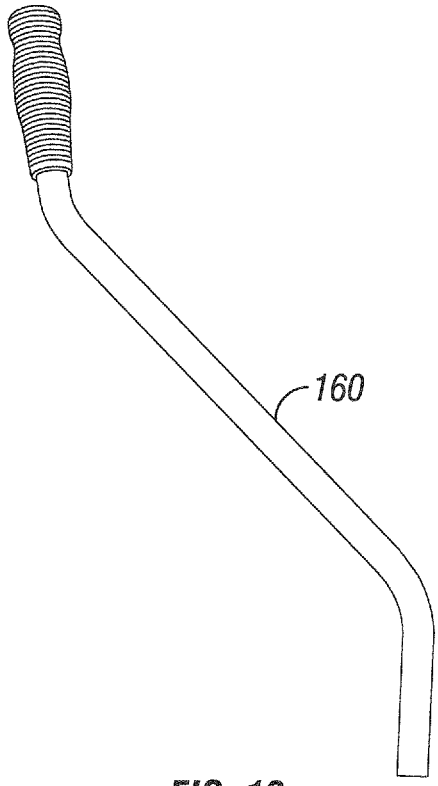
FIG. 10 is a side view of a pump handle of the sprayer device of FIG. 7.
Figure 11:
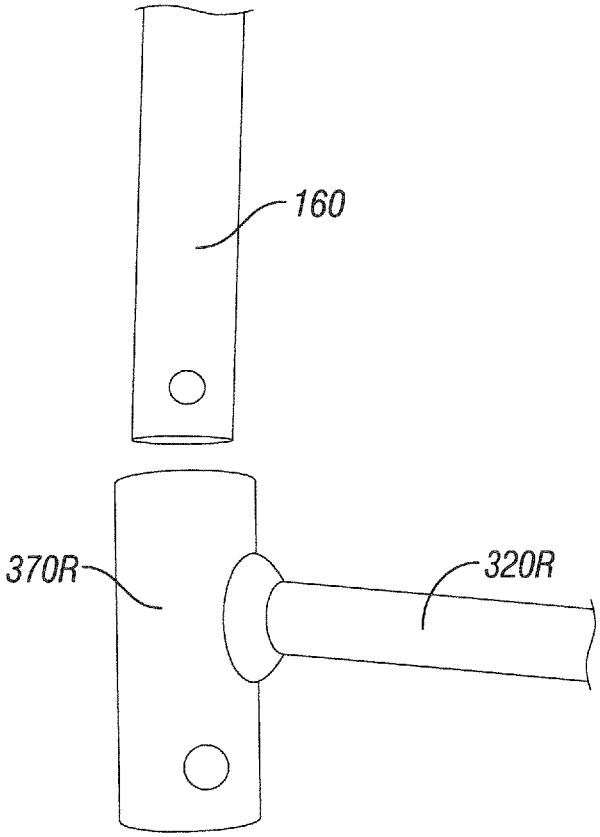
FIG. 11 is a partial side view of the bottom end of the pump handle of FIG. 4 as it is being inserted into a handle connection fitting on one end of the split axle.

As seen in the views of FIGS. 7 through 9, one end of the pump drive bracket 340 is configured to fit over and bolt to the inner ends of the right and left axle portions 320R, 320L, thereby joining the axle portions 320R, 320L together to form a unitary axle 320 as well as firmly connecting them to the pump drive bracket 340 such that subsequent back and forth rotation of the axle 320 will cause corresponding advancement and retraction of the pump drive bracket 340. As may be appreciated from the views of FIGS. 8 and 9, the inner ends of the right and left axle portions 320R, 320L may have mating shapes (e.g., slotted or "crown shaped" configurations) which interlock or frictionally engage one another to facilitate their firm interconnection and subsequent torque transmission between the right and left axle portions 320R, 320L.

Figure 15:
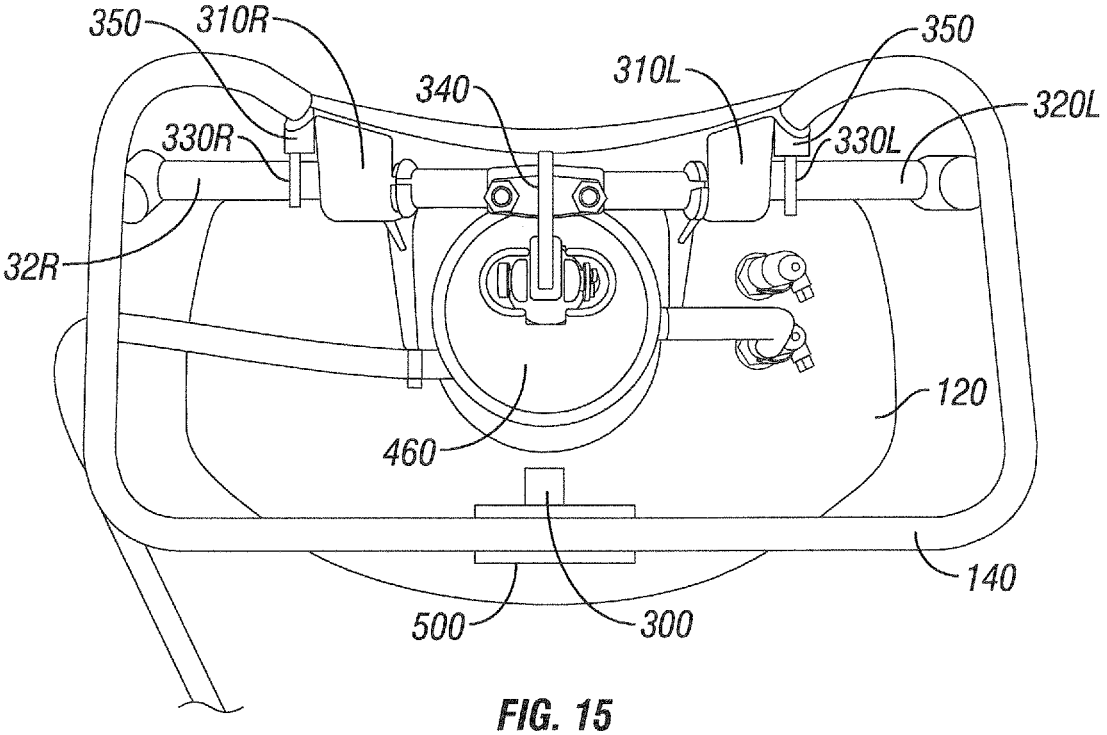
FIG. 15 is a bottom view of the sprayer device of FIG. 7.
Figure 16:
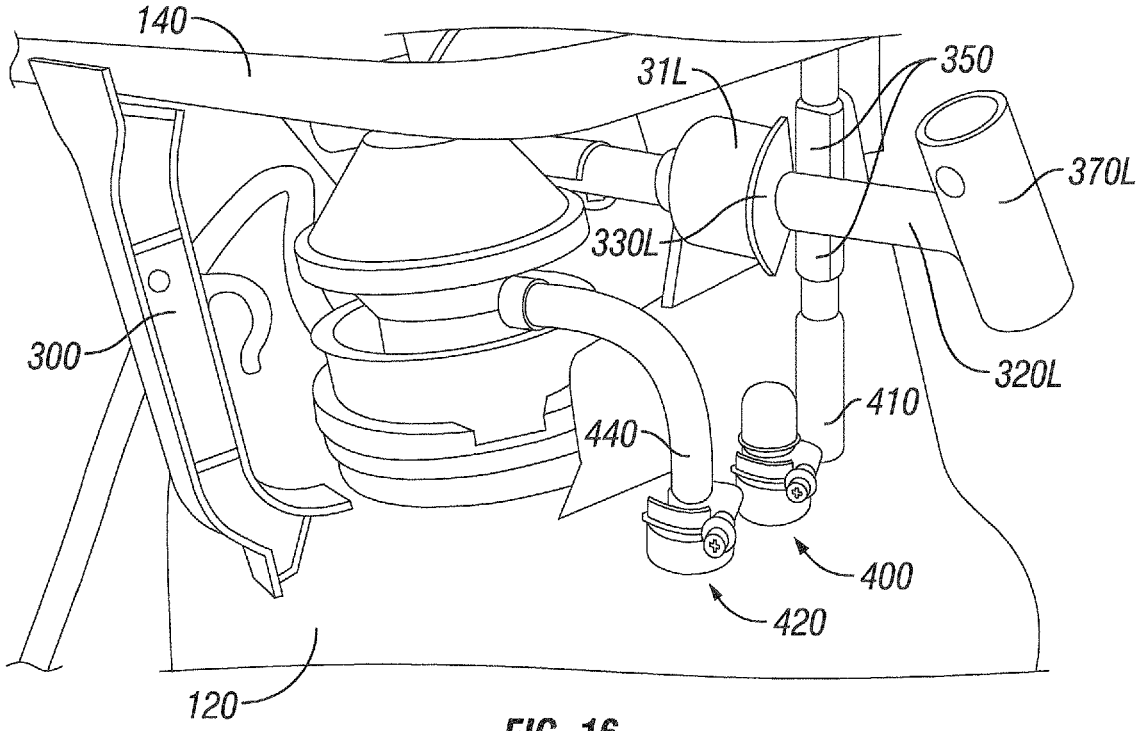
FIG. 16 is a partial bottom perspective view of the sprayer device of FIG. 1 showing its agitation and non-agitation ports.

As may be appreciated from the showing of FIGS. 15 and 16, the degree to which the axle 320 may rotate is limited by the interaction of first and second stop member 330R, 330L with adjacent abutment surfaces 350. The first stop member 330R is formed on or attached (e.g., welded) to the right axle portion 320R and the second stop member 330L is formed on or attached (e.g., welded) to the left axle portion 320L. When the axle 320 has been inserted and assembled in the manner described above, these first and second stop members 330R, 330L will reside adjacent to abutment surfaces 350 formed on the device 100. In this example, the abutment surfaces 350 are molded plastic structures beneath the tank 120 on the lateral side of each axle guide 310. These stop member's may be of any suitable design or configuration. In the particular non-limiting example shown in the figures, each stop member 330R, 330L comprises a portion of an annular member (e.g., slightly less than half of a flat washer) that has been welded or otherwise firmly affixed to the axle 320. Those of skill in the art will understand that various alternative projections or protrusions could be used instead of this partial annular member. The leading edges of both stop members 330R, 330L will abut against their respective abutment surfaces 350 simultaneously (i.e., at concurrent points in the clockwise and counterclockwise rotation of the axle 320). The redundant provision of separate stop members 330R, 330L with separate abutment surfaces 350 on either side of the pump 150 ensures that firm limitation and stopping of axle rotation 320 will occur, irrespective of which end of the axle 320 the pump handle 160 is attached to. Also, these redundant stop members 330R, 330L with associated abutment surfaces on either side of the pump 150 helps to avoiding excessive twisting or strain on the axle assembly and avoids potential for damage, loosening, bending, deformation or other impairment of the connection between the axle portions 320R, 320L and the pump drive bracket 340. The stop members 330R, 330L and adjacent abutment surfaces 350 will be sized and positioned relative to each other so that both members 330R, 330L meet with and contact their respective abutment surfaces 350 at the same point of axle rotation (i.e., simultaneously), thereby performing their stopping functions concurrently. In many embodiments, these components will be sized to allow about 25 degrees to about 30 degrees, and preferably about 30 degrees, of axle rotation in either direction from stop point to stop point.

After the axle 320 has been fully installed, the pump handle 160 is attached to either the right or left end of the axle 320. Pump handle connector fittings 370R and 370L are formed on the outer ends of the right and left axle portions 320R, 320L, respectively. In this example, the pump handle connector fittings 370R and 370L comprise short sections of metal tubing affixed on the outer end of each axle portion 320R, 320L at a slight angle such that when the bottom end of the pump handle 16 is inserted into the desired pump handle connector fitting 370R or 370L, the pump handle 160 will extend upwardly and slightly outwardly to one side of the tank 120. In this example, through holes are formed in the bottom of the pump handle 16 and in each pump handle connector fitting 370R, 370L so that a locking pin or bolt may be placed to firmly and non-rotatably lock the pump handle 160 in the desired pump handle connector fitting 370R or 370L.

In use, the device will typically be worn on the users back and the user will repetitively move the pump handle 160 up and down between stopping points dictated by concurrent abutment of the stop members 330R, 330L with their respective abutment surfaces 350. This will allow effective pumping of liquid from the tank 120 out of the spray emitting apparatus 180 by either a right-handed or left-handed user.

C. System for Selective and/or Controlled Agitation or Non-Agitation of Liquid within the Sprayer Tank In use, the tank 120 of the sprayer device has an inner space or cavity that is typically filed with liquid up to some liquid level (e.g., the upper surface of the liquid within the tank). As the pump 150 is used to pump liquid from the tank out of the spray emitting apparatus 180, some blow-by or leakage from the pump 150 may occur. The about of such leakage may increase as the pump 150 become worn. The prior art has included a system wherein the sprayer uses a combined piston and diaphragm pump with a collection chamber below the pump 150 to collect leaking liquid. Liquid that collects within that collection chamber then flows through a recirculation loop and back into the tank. This is described in Applicant's prior U.S. Pat. No. 4,798,333, the entire disclosure of which is expressly incorporated by reference. In this prior art system, the re-circulated liquid enters the bottom of the tank (i.e., blow the liquid level). Because the action of the diaphragm pump causes back and forth movement of the liquid, this results in agitation of the liquid within the tank. While some agitation of liquid may be desirable for certain types of chemical, there are situations where agitation is undesirable, such as with chemical solutions that tend to froth or foam when agitated.

The present invention provides an improved system for re-circulating collected liquid back into the tank such that some or all of the re-circulating liquid may be alternatively channeled through a conduit that delivers the liquid into the inner space of the tank above the liquid level, thereby not causing substantial agitation of the tanked liquid. In some embodiments, this may be accomplished by providing separate agitation and non-agitation ports on the tank so that the user can simply connect the recirculation conduit to the agitation port (if agitation is desired) or to the non-agitation port (if no agitation is desired). In other embodiments a valve may be provided for selectively channeling a desired portion (e.g., 1 to 100%) of the re-circulated liquid into either the agitation port or the non-agitation port.

As may be appreciated from FIGS. 15 and 16, the sprayer device 100 of this example also incorporates an agitation port 400 and a non-agitation port 420. The agitation port 400 leads to an opening in the bottom wall or floor of the tank 120. The non-agitation port 420 leads to a conduit which comprises a stand pipe extending vertically within the tank 120, such stand pipe having an open top end near the top of the tank 120. The open top end of the stand pipe will typically be above the standing liquid level within the tank 120. In the example shown, a recirculation conduit 440, such as a flexible plastic tube, is used to alternatively carry liquid from a connection chamber 460 below the pump 150 to either the agitation port 400 or non-agitation port 420. In the particular example shown, the recirculation conduit 440 is connected (e.g., by a hose clamp) to the non-agitation port 420 and a cap 410 is connected (e.g., by a hose clamp) to the agitation port 400. Thus, in this configuration, liquid is pumped, in pulsating or back and forth fashion, from the collection chamber 460, through conduit 440 and through non-agitation port 420. When the tank 120 is in its usual upright position (as when worn on the back of an operator) the liquid will eventually full the stand pipe and will overflow from the top end of the stand pipe, thereby entering a gas-filled region of the inner space of the tank 120 above the standing liquid level. In this manner, the liquid flowing out of the top of the stand pipe will simply combine with liquid contained within the tank 120 without causing agitation of the tanked liquid.

If and when agitation of the tanked liquid is desired, the recirculation conduit 440 may be connected (e.g., by a hose clamp) to the agitation port 400 and the cap 410 may be connected (e.g., by a hose clamp) to the non-agitation port 420. In such alternative configuration, liquid would be pumped, in pulsating or back and forth fashion, from the collection chamber 46, through conduit 440 and through agitation port 420. When the tank 120 is in its usual upright position (as when worn on the back of an operator) this will result in pulsating or back and forth movement of the re-circulating liquid (along with any entrained gas) through an opening in the bottom of the tank 120 thereby entering directly into the standing liquid within the tank 120 at a location below the tanked liquid's upper surface or liquid level. This will result in agitation of the tanked liquid concurrently with mixing of the re-circulated liquid with the mass of liquid contained within the inner space of the tank 120.

In some embodiments, the simple moveable recirculation conduit 440 shown in this example may be replaced with duplicate recirculation lines or a single bifurcated or branched (e.g., a Y or T) recirculation line, so as to maintain constant fluidic connection between the collection chamber 46*o* and both ports 400, 420. A suitable type of manually-actuatable or power-actuatable diverter device (e.g., a flow splitter, manifold, diverter valve, three way valve, three-way stop cock, mixing valve, etc) may be provided for selectively channeling desired portion(s) (e.g., between 0% and 100%) of the re-circulated liquid into either the agitation port 400 or the non-agitation port 420. In some embodiments, this would allow the user to easily switch back and forth between an agitation mode (where all of the re-circulated liquid enters the agitation port 400) and a non-agitation mode (where all of the re-circulated liquid enters the non-agitation port 420). Or, in embodiments where a variable mixing valve apparatus is used, this may allow the operator to make adjustments to the amount or degree of agitation by adjusting the relative portions (e.g., 60% agitation/40% non-agitation; 10% agitation/90% non-agitation, etc . . . , etc. . . . ).

D. Information Card Holding Niche with Removable Information Card

Figure 17:
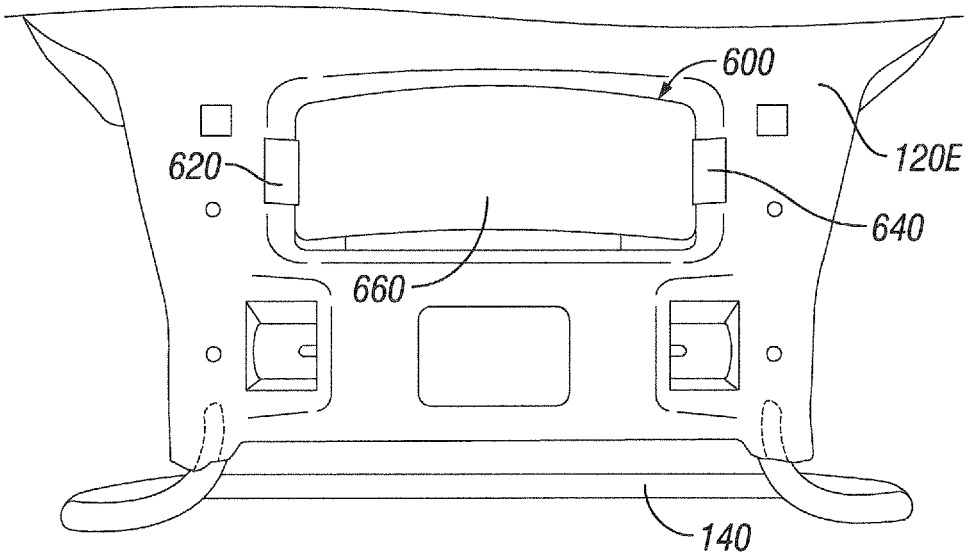
FIG. 17 is a front view of a bottom portion the sprayer device of FIG. 1 showing its removable information card and card-holding niche.

Optionally, any sprayer device may, in accordance with the present invention, incorporate a card-holding niche for holding an information card (e.g., a small placard with information printed on it). Such information card may, in at least some instances, comprise a resilient, wear and/or liquid resistant card that flexes of deforms in a manner that facilitates its stowage in the card-holding niche. A non-limiting example of this is seen in FIG. 17. In the example shown, the card-holding niche 600 comprises a recessed area in an outer wall or base appendage of the tank 120 with card-engaging members 620, 640, such as tabs or protrusions, on opposite sides of the niche 600. These card-engaging members 620, 640 are spaced and configured to engage opposite edges of an information card 660. The information card 660 comprises a substantially flat card that is elastically deformable to, and constrainable in, a bowed shape when its ends are inserted under the card-holding members 620, 640, as seen in FIG. 17. When removed from the niche 600, the card 660 may spring back to or resiliently reassume its substantially flat shape. To facilitate such operability, the distance between the card-engaging members 620, 640 may be such that the information card 660 may be manually compressed or deformed to a bowed configuration and inserted between spaced-apart card-engaging members 620, 640 with its ends inserted under the card-holding members 620, 640. The card 660 is then released, allowing the severity of the bowed shape to relax and causing the opposite ends (or edges) of the card 660 to frictionally engage the card-engaging members 620, 640 thereby holding the card 66 in place within the niche 600. When needed, the information card 660 may be removed from the niche 600 by manually compressing the card to a more severely bowed configuration so as to disengage the opposite ends (or edges) of the card 66 from the spaced-apart card-engaging members 620, 640. This allows the user to easily read the information on the information card and/or to transport the information card to another location, such as a medical treatment facility, where information printed on the card is needed or desirably accessed. The information card 660 may be of liquid resistant plastic construction and may bear information that is desired, or required by law, to be available to the user of the sprayer device 100 such as toxicity or safely information relating to the particular material being sprayed by the sprayer device 100 at the present time, sprayer care information, or maintenance instructions, warnings, etc.

It is to be appreciated that, although the invention has been described hereabove with reference to certain examples or embodiments of the invention, various additions, deletions, alterations and modifications may be made to those described examples and embodiments without departing from the intended spirit and scope of the invention. For example, any elements, steps, members, components, compositions, reactants, parts or portions of one embodiment or example may be incorporated into or used with another embodiment or example, unless otherwise specified or unless doing so would render that embodiment or example unsuitable for its intended use. Also, where the steps of a method or process have been described or listed in a particular order, the order of such steps may be changed unless otherwise specified or unless doing so would render the method or process unsuitable for its intended purpose. Additionally, the elements, steps, members, components, compositions, reactants, parts or portions of any invention or example described herein may optionally exist or be utilized in the absence or substantial absence of other elements, steps, members, components, compositions, reactants, parts or portions, unless otherwise noted. All reasonable additions, deletions, modifications and alterations are to be considered equivalents of the described examples and embodiments and are to be included within the scope of the following claims.

What is claimed is:

1. A sprayer device adapted to be worn on the body of a user, said sprayer device comprising:

a tank;

a spray emitting apparatus connected to the tank;

a pump for pumping liquid from the tank through the spray emitting apparatus;

a pump driving axle for driving the pump, said pump driving axle having right and left ends;

a pump handle alternately connectable to either the right end or left end of the pump driving axle to permit the user to selectively use either his/her right hand or his/her left hand to repeatedly move the pump handle up and down, thereby causing reciprocating clockwise/counterclockwise partial rotation of the pump driving axle;

a first stop member attached to or formed on the axle at a first location to the right of the pump and first stop member abutment surfaces formed on the device to limit the range of movement of the first stop member, thereby limiting the degree of partial rotation of the pump drive axle; and, a second stop member attached to or formed on the axle at a second location to the left of the pump and second stop member abutment surfaces formed on the device to limit the range of movement of the second stop member, thereby also limiting the degree of partial rotation of the pump drive axle.

2. A sprayer device according to claim 1 wherein the device has pump axle guides formed therein and wherein the pump axle extends through those pump axle guides.

3. A sprayer device according to claim 1 wherein the pump axle comprises a) a right axle portion having an inner end and an outer end and b) a left axle portion having an inner end and an outer end, therein the right axle portion is inserted inner-end-first from a right side of the tank, the left axle portion is inserted inner-end-first from a left side of the tank and the inner ends of the right and left axle portions are then connected to form said axle.

4. A sprayer device according to claim 3 wherein the pump comprises a piston pump and wherein the inner ends of the right and left axle portions are jointly connected to a pump piston driving bracket, said pump piston driving bracket being operative to a) connect the right axle portion and left axle portion together to form said axle and b) reciprocally drive a piston of the pump as the axle undergoes reciprocating back and forth partial rotation.

5. A sprayer device according to claim 4 wherein pump handle connecting structures are formed on the outer ends of the right and left axle portions.

6. A sprayer device according to claim 5 wherein the pump handle connecting structures comprise tubular structures configured such that a bottom end of the pump handle may be inserted into a selected one of the tubular structures.

7. A sprayer device according to claim 5 further comprising a locking pin or bolt for locking the pump handle to a selected one of the pump handle connecting structures.

8. A sprayer device according to claim 1 wherein the first and second stop member abutment surfaces are constructed to allow the axle to under go approximately 25 to 30 degrees rotation in either direction.

9. A sprayer device according to claim 1 wherein the tank is formed of molded plastic and the axle guides are molded integrally with the tank.

10. A sprayer device according to claim 1 wherein the spray emitting apparatus is selected from: spray gun and sprayer wand.

11. A sprayer device according to claim 1 wherein the tank is formed of molded plastic and the first and second stop member abutment surfaces are molded integrally with the tank.

12. A sprayer device according to claim 1 wherein the first and second stop members come into contact with the respective first and second stop member abutment surfaces at the same time to firmly stop clockwise or counterclockwise rotation of the axle.

13. A sprayer device according to claim 1 further comprising straps for mounting the device on the back of a user.

* * * * *